United States Patent [19]

Lew et al.

[11] Patent Number: 4,498,371

[45] Date of Patent: Feb. 12, 1985

[54] DIRECT ACTING ROTARY ACTUATOR CYLINDER

[76] Inventors: Yon S. Lew; Hyok S. Lew, both of 7890 Oak St., Arvada, Colo. 80005

[21] Appl. No.: 392,629

[22] Filed: Jun. 28, 1982

[51] Int. Cl.[3] ..... F01B 3/08

[52] U.S. Cl. ..... 92/2; 92/23; 92/27; 92/33; 91/21; 91/26; 91/27; 91/44; 91/189 A; 91/392; 251/56

[58] Field of Search ..... 92/2, 15, 28, 31, 33, 92/69 R, 165 PR, 23, 27; 91/21, 24, 25, 26, 27, 43, 44, 45, 189 R, 189 A, 392; 251/56

[56] References Cited

U.S. PATENT DOCUMENTS

| | | | |
|---|---|---|---|
| 2,632,426 | 3/1953 | Geesink | 92/33 |
| 2,918,799 | 12/1959 | Geyer | 92/33 |
| 2,948,265 | 8/1960 | Jensen et al. | 91/26 |
| 3,388,603 | 6/1968 | Clark | 92/33 |
| 3,961,559 | 6/1976 | Teramachi | 92/2 |
| 4,024,794 | 5/1977 | Grubb | 91/189 A |
| 4,092,213 | 5/1978 | Nishimura | 92/33 |
| 4,114,517 | 9/1978 | Teramachi | 92/2 |
| 4,192,482 | 3/1980 | Goldman et al. | 92/2 |

*Primary Examiner*—Robert E. Garrett
*Assistant Examiner*—Richard S. Meyer

[57] ABSTRACT

This invention relates to direct acting rotary actuator cylinders wherein the linear motion of the piston is directly converted to angular motion by a means completely enclosed within the cylinder, which means comprises a slidable partitioning body engaging the circular cylindrical cavity in the cylinder in an air-tight sliding relationship and a circular cylindrical rod coaxially and rotatably disposed in said circular cylindrical cavity having a mid-section with a noncircular cross section of a diametrical dimension greater than the diameter of said circular cylindrical rod. Said slidable partitioning body comprises the first cylindrical member with a centrally disposed hole of noncircular cross section slidably and nonrotatably receiving said noncircular midsection of the circular cylindrical rod and slidably and rotatably receiving the circular portion of said circular cylindrical rod, which first cylindrical member further includes a means for converting the linear movement of said slidable partitioning body to the angular movement, and the second cylindrical member with the centrally disposed circular hole slidably and rotatably receiving the circular portion of said circular cylindrical rod in an air-tight manner, which second cylindrical member generates the linear movement powered by the difference in the fluid pressure acting on two opposite ends of said second cylindrical member. A means for generating a small amount of the linear movement on said circular cylindrical rod prior to its rotational movement in one direction and for completing the returning rotational movement followed by another small amount of the linear movement in the opposite direction is further included.

10 Claims, 5 Drawing Figures

DIRECT ACTING ROTARY ACTUATOR CYLINDER

The inventors of the present invention have invented and developed the new breed of the valves namely, the free disc valve (U.S. Pat. No. 432,206) and the ball plug valves (U.S. Ser. No. 334,441, now abandoned) wherein the seating pressure between the blocking body and the valve seat on the valve body can be established for a leak-proof shutoff and relieved for a frictionless opening and closing, which control of the seating pressure is controlled by a small amount of the axial movement of the valve stem mechanically connected to the blocking body in either direction. Said new breed of the valves can be operated by the rotary actuator cylinder generating a reasonably low torque when said rotary actuator is provided with a feature that generates a small linear movement of the cylinder rod prior to the rotation to the other extreme angular position and the returning rotational movement to the initial angular position is followed by another small linear movement in the opposite direction, since there is little frictional resistance to the rotating motion of the blocking body once the seating pressure is relieved in said new breed of the valves, which relief action is accomplished by the small axial movement of the cylinder rod that pulls and pushes the valve stem to relieve and to establish the seating pressure.

The primary object of the present invention is to provide the direct acting rotary actuator cylinders employing the cylinder rod of a circular cross section with a mid section having a noncircular cross section of diametrical dimension greater than the diameter of the circular section.

Another object of the present invention is to provide the direct acting rotary actuator cylinders employing a slidable partitioning body slidably engaging the circular cylindrical cavity of said actuator cylinder, which slidable partitioning body comprises the first cylindrical member with a centrally disposed noncircular hole slidably and nonrotatably receiving said noncircular midsection of the cylinder rod and the second cylindrical member with a centrally disposed circular hole slidably and rotatably receiving the circular portion of said cylinder rod, wherein said first cylindrical member includes a means for converting the linear movement of said first cylindrical member to the rotational movement of said cylinder rod, while said second cylindrical member generates the linear movement by utilizing the difference in the fluid pressure on two opposite ends of second cylindrical member.

A further object of the present invention is to provide the direct acting rotary actuator cylinders providing the small amount of the axial movement of the cylinder rod prior to the rotational movement to the other extreme angular position and another small amount of the axial movement after the cylinder rod is rotated back to the initial angular position.

Yet another object of the present invention is to provide the direct acting rotary actuator cylinders which returns to the initial linear and angular position automatically by the air spring action whenever the supply of the pressurized fluid to said actuator cylinder is halted or fails.

Yet a further object of the present invention is to provide the direct acting rotary actuator cylinders operating in an extra smooth mode.

These and other objects of the present invention will become clear as the description thereof proceeds. The present invention may be described with a great clarity and specificity by referring to the following Figures.

Figure 1:
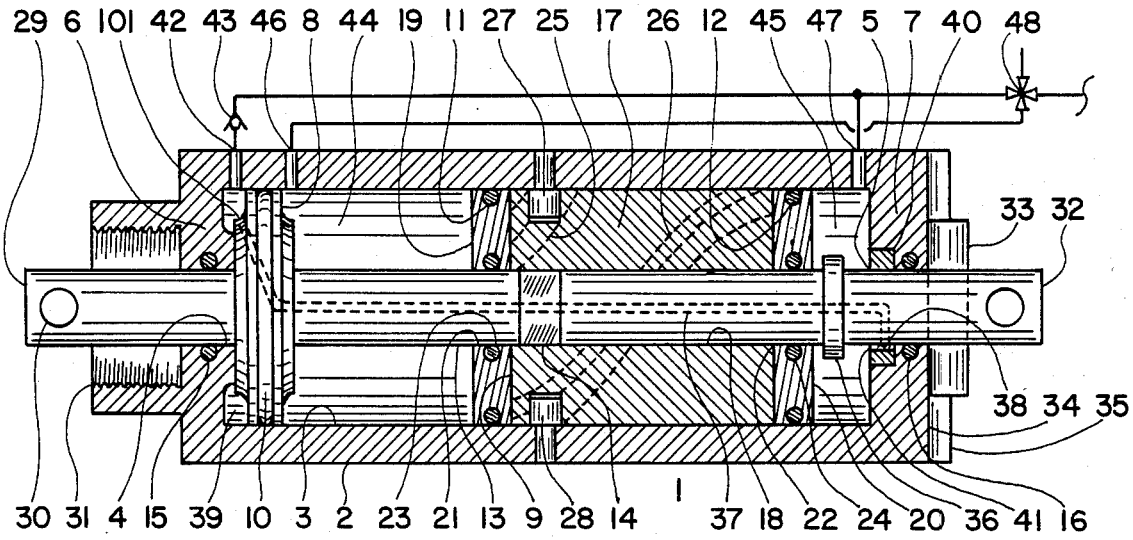
FIG. 1 illustrates a cross section of a direct acting rotary actuator cylinder with the initial linear movement, which is constructed in accordance with the principles of the present invention.

In FIG. 1 there is illustrated a cross section of a direct acting rotary actuator cylinder with the initial linear movement of the cylinder rod constructed in accordance with the principles of the present invention, which cross section is taken along a plane including the central axis of said actuator cylinder. The direct acting rotary actuator cylinder 1 comprises a cylinder 2 including a circular cylindrical cavity 3 with a pair of the coaxially disposed holes 4 and 5 through two opposite end walls 6 and 7. The circular cylindrical cavity 3 is slidably engaged by a pair of the slidable partitioning bodies 8 and 9 dividing the circular cylindrical cavity 3 into four separate air-tight compartments, wherein the sliding movement of said slidable partitioning bodies 8 and 9 in the circular cylindrical cavity 3 is in an air-tight manner as facilitated by the sealing means 10 disposed around the outer cylindrical surface of the first slidable partitioning body 8 and the pair of the sealing means 11 and 12 disposed around the pair of the circular discs included in the second slidable partitioning body 9. The rod 13 coaxially disposed in the circular cylindrical cavity 3 and slidably as well as rotatably engaging and extending through the holes 4 and 5 disposed on two opposite extremities of the cylinder 2 has a circular cross section over most of its length with the exception of its midsection 14 which has a noncircular cross section of the minimum diametrical dimension greater than the diameter of the circular section; whereby, a matching noncircular hole receiving the noncircular midsection 14 of the rod 13 in a sliding and nonrotating relationship also receives the circular portion of the rod 13 in a free-sliding and free-rotating relationship. The engagement of the holes 4 and 5 by the rod 13 in a sliding and rotating relationship is made air-tight by means of the sealing means 15 and 16 respectively disposed in said holes. The first slidable partitioning body 8 is nonslidably connected to the rod 13 in the coaxial relationship, while the second slidable partitioning body 9 is slidably connected to the rod in the coaxial relationship. The second slidable partitioning body 9 comprises the first cylindrical member 17 having a centrally disposed noncircular hole 18 slidably and nonrotatably receiving the noncircular midsection 14 of the rod 13, which hole 18 also receives the circular portion of the rod 13 in a sliding and rotating relationship, and the second cylindrical member including a pair of the circular cylindrical discs 19 and 20 with the centrally disposed circular holes 21 and 22, respectively, which holes slidably and rotatably receive the circular portion of the rod 13 in an air-tight manner as facilitated by the pair of the seals 23 and 24. The engagement of the cylindrical wall of the circular cylindrical cavity 3 by the pair of the circular discs 19 and 20 is also in an air-tight sliding relationship as facilitated by the sealing means 11 and 12. While the second cylindrical member including the circular cylindrical discs 19 and 20 provides an air-tight slidable partitioning function to the second slidable partitioning body 9, the first member 17 includes a means for converting the linear movement of the second slidable partitioning body 9 in one direction to a rotational movement in one direction and the linear movement in another opposite direction to the rotational movement in another opposite direction, which means is illustratively embodied by one or more of the helical grooves with the common pitch angle 25, 26, etc. disposed parallel to each other on the outer cylindrical surface of the first cylindrical member 17, each of which grooves is slidably engaged by one or more of the guide means such as matching helical rails or the cam rollers 27, 28, etc. rigidly affixed to the cylindrical wall of the circular cylindrical cavity 3; whereby, the linear movement of the second slidable partitioning body 9 generated by the second cylindrical member including the circular cylindrical discs 19 and 20 from the pressure difference on two opposite ends creates the rotational movement of the first cylindrical member 17, which rotational movement is then transmitted to the rod 13 by means of the noncircular hole 18 slidably and nonrotatably receiving the noncircular midsection 14 of the rod 13. For a light duty application, single cam roller may be asigned to each of the grooves with the common pitch angle, while more than one cam rollers may be asigned to each of said grooves for a heavy duty application. The both extremities 29 and 32 of the rod extending out of the end walls 6 and 7 of the circular cylindrical cavity 3 are provided with a coupling means 30 for coupling said extremity of the rod to the valve stem of said new breed of the valves. The cylinder 2 includes the mounting means 31 for mounting the actuator cylinder 1 to the frame or body of the equipment to be operated. The extremity 32 of the rod 13 extending through the end wall 7 includes mechanical locking means such as a locking pin 33 rigidly connected to said rod 13 and extending radially from said rod 13, which locking pin 33 is received by a matching seat 34 disposed on the face 35 of the end wall 7 in the radial direction extending from the hole 5 disposed through the end wall 7 when the actuator cylinder 1 is at one extreme linear and angular position. The rod 13 may include a shoulder 36 for limiting the linear movement of said rod relative to the cylinder 2. A fluid passage 37 is routed through the rod 13 wherein one opening 101 is open to the first compartment 39 intermediate the first end wall 6 and the first slidable partitioning body 8, while the other opening 38 emerges on the cylindrical surface of the rod 13 which opening becomes open only when said opening 38 is lined up with the slit 41 included in the seal ring 40, which combination occurs when the actuator cylinder 1 is at said one extreme linear and angular position. The first compartment 39 has a port opening 42 with a check valve 43; whereby, the pressurized fluid such as the compressed air entering the compartment 39 becomes trapped in said compartment, which trapped compressed air is released through the fluid passage 37 only when the opening 38 is lined up with the slit 41 of the seal ring 40. The compartment 44 intermediate the first slidable partitioning body 8 and the second slidable partitioning body 9 is provided with the port opening 46, while the port opening 47 is included in the compartment 45 intermediate the second slidable partitioning body 9 and the second end wall 7.

With the construction as shown in FIG. 1, the direct acting rotary actuator cylinder 1 operates in the following principles: At the one extreme position as shown in FIG. 1, which one extreme position corresponds to the "closed" position of said free disc valve or the ball plug valve, the compartment 44 is pressurized, while the compartments 39 and 45 are vented, which combination is accomplished by the use of the four way control valve 48. It should be noticed that, at said one extreme angular position, the compartments 39 and 45 are open to one another by means of the fluid passage 37 as its opening 38 is lined up with the slit 41 of the seal ring 40. It should be understood that, at said one extreme linear and angular position as shown in FIG. 1, the rod 13 is shifted to one extreme linear position and is rotated to one extreme angular position wherein the locking pin 33 lines up with and engages the seat 34 and, consequently, the rod 13 is locked at said one extreme angular position and is prevented from being rotated. At said one extreme linear and angular position, the second slidable partitioning body 9 is held at a position without exerting any force on the rod 13 in the axial direction as the cam rollers 27, 28, etc. in contact with one of the circular cylindrical discs 19 or 20 or in contact with the stop means disposed at the end of each of the grooves with the common pitch angle 25, 26, etc. stop the second slidable partitioning body 9 and hold it at an predesignated position. In order to activate the actuator cylinder 1 to the other extreme linear and angular position, which corresponds to the open position of the free disc valve or the ball plug valve, the compartment 39 and 45 are pressurized while the compartment 44 is vented by manipulating the four way control valve 48. The pressurization of the compartment 39 first moves the rod 13 to the other extreme linear position, in which process the pin 33 is lifted out of the groove 34 which implies that the valve stem is pulled out to a full extent and the seating pressure between the blocking body and the valve seat is relieved. Consequently, the rod 13 is rotated to the other extreme angular position by the pressure of the compressed air in the compartment 45 and the actuator cylinder stays at the other extreme linear and angular position as long as the compartments 38 and 45 remain pressurized. In order to actuate the actuator cylinder back to said one extreme linear and angular position as illustrated in FIG. 1, the compartment 44 is pressurized while the compartments 39 and 45 are vented by again manipulating the four way control valve 48. Here, it should be noticed that the compartment 45 is vented immediately while the compartment 39 remains pressurized because of the check valve 43 and the blocked opening 38 of the fluid passage 37 by the seal ring 40. Remember that the opening 38 is rotated away from the position lining up with the slit 41 of the seal ring 40 when the actuator cylinder was activated to said the other extreme linear and angular position. When the rod 13 is fully rotated back to said one extreme angular position where the opening 38 of the fluid passage lines up with the slit 41 of the seal ring 40, the compartment 39 becomes vented at last, at which position the pin 33 is placed directly above the groove 34 and, consequently, the rod 13 is moved to said one extreme linear position by the pressure in the compartment 44 acting upon one face of the first slidable partitioning body 8, which shifting motion of the rod 13 re-establishes the seating pressure between the blocking body and the valve seat of said new breed of the valve. It is readily recognized that the direct acting rotary actuator cylinder 1 functions without the check valve 43 and the fluid passage 37 with the side opening 38, since the pin 33 riding the top surface of the end face 35 prevents the rod 13 from shifting to one extreme linear position untill the rod 13 is fully rotated to one extreme angular position where the pin 33 is positioned directly above the groove 34 and, consequently, the pin 33 is allowed to engage the groove 34. The sole purpose of the employment of the check valve 43 and the fluid passage 37 with the side opening 38 is to minimize the contact pressure between the pin 33 and the end face 35; whereby, a smooth and easy rotation of the pin 33 relative to the end face 35 as well as a soft landing of the pin 33 into the groove 34 is accomplished. It is also easy to recognize that only one of two circular cylindrical discs 19 and 20 is actually needed in providing the air-tight slidable partitioning function to the second slidable partitioning body 9. In the case where only single circular cylindrical disc is included in the second cylindrical member of the second slidable partitioning body 9, said circular cylindrical disc must be rigidly connected to the first cylindrical member 17 and the extremities of the grooves with the common pitch angle 25, 26, etc. must include the stop means to limit the sliding movement of the second slidable partitioning body 9 in the direction parallel to the central axis of the actuator cylinder to the desired extent. For those actuator cylinders operating the free disc valves of large port size, the rod 13 may experience an axial force of a large magnitude transfered through the valve stem to the rod 13. As a consequence, a very large shifting force may be required to generate the initial linear movement for the rod 13.

Figure 2:
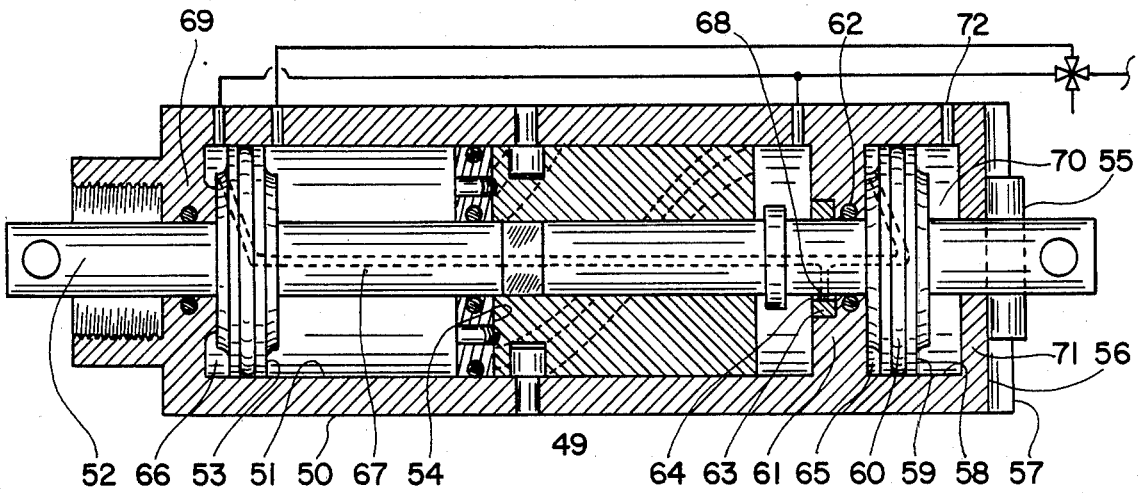
FIG. 2 illustrates another direct acting rotary actuator cylinder with an extra power to create the initial linear movement.

In FIG. 2 there is shown a cross section of another direct acting rotary actuator cylinder with the initial linear movement having an extra large shifting force for generating the initial linear movement for the cylinder rod, which cross section is taken along a plane including the central axis of the actuator cylinder. The actuator cylinder 49 has a construction essentially similar to the actuator cylinder 1 of FIG. 1 with one exception. The arrangement including the cylinder 50 with the circular cylindrical cavity 51, the rod 52 with the radially extending pin, the first slidable partitioning body 53, the second slidable partitioning body 54, the pin 55 and the matching groove 56 disposed on the second end face, etc. are same as the arrangement of the corresponding elements in the actuator cylinder 1 of FIG. 1. The exception is the inclusion of the second circular cylindrical cavity 58 slidably engaged by the third slidable partitioning body 59 in an air-tight manner as facilitated by the sealing means 60, which third slidable partitioning body 59 is rigidly connected to the rod 52 in the coaxial relationship. The partitioning wall 61 separating the first and second circular cylindrical cavities 51 and 58 from one another includes a centrally disposed circular hole with the sealing means 62 slidably and rotatably engaged by the rod 52. The seal ring 63 with the slit 64, into which the side opening 68 of the fluid passage 67 is directed, is also included in the partitioning wall 61. The compartment 65 intermediate the partitioning wall 61 and the third slidable partitioning body 59 and the compartment 66 intermediate the first end wall 69 and the first slidable partitioning body 53 are connected to one another by the fluid passage 67 routed through the rod 52 wherein the side opening 68 of said fluid passage 67 emerges into the seal ring 63 with the slit 64. The compartment 70 intermediate the third slidable partitioning body 59 and the second end wall 71 includes a vent opening 72. It should be noticed that the second cylindrical member of the second slidable partitioning body 54 includes only one circular cylindrical disc connected to the first cylindrical member by spot-weld and, consequently, it should be understood that the extremities of the grooves with the common pitch angle include the stop means that limit the movement of the second slidable partitioning body 54 to a desirable range. The actuator cylinder 49 operates in much the same principle as the actuator cylinder 1 of FIG. 1. The pressurization of the compartment 66 and the compartment intermediate the second slidable partitioning body 54 and the partitioning wall 61 automatically pressurizes the compartment 65 and venting of the compartment intermediate the first and second slidable partitioning bodies 53 and 54 at the same time actuates the actuator cylinder 49 to said the other extreme linear and angular position, in which process the force shifting the rod 52 to said the other extreme linear position from said one extreme linear position twice greater than that generated by the actuator cylinder 1 of FIG. 1 is generated. The pressurization of the compartment intermediate the first and second slidable partitioning bodies 53 and 54 and the simultaneous venting of the compartments 66 and 65 and the compartment intermediate the second slidable partitioning body 54 and the partitioning wall 61 returns the actuator cylinder 49 to said one extreme linear and angular position, in which process the venting of the compartments 66 and 65 takes place in a delayed mode while the compartment intermediate the second slidable partitioning body 54 and the partitioning wall 61 is vented instantly. The delayed venting of the compartments 66 and 65 is due to the side opening 68 of the fluid passage 67 that remains blocked by the seal ring 63 untill the rod 52 is fully rotated to said one extreme angular position where the side opening 68 lines up with the slit 64 included in the seal ring 63.

Figure 3:
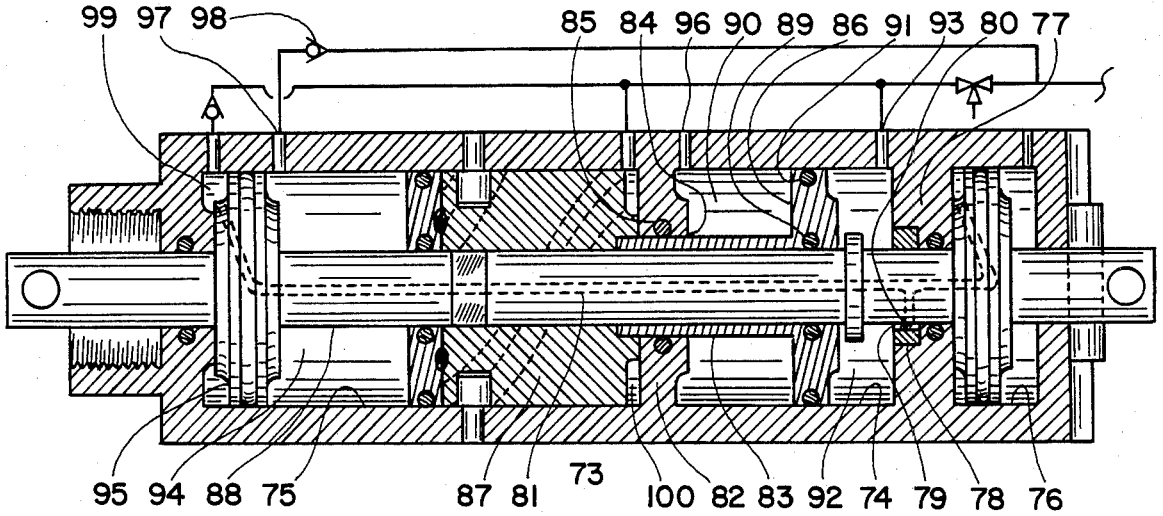
FIG. 3 illustrates a further direct acting rotary actuator cylinder with the initial linear movement, which returns to the initial linear and angular position automatically whenever the supply of the pressurized fluid to said actuator cylinder is halted or fails.

In FIG. 3 there is illustrated a cross section of an air spring return direct acting rotary actuator cylinder with the initial linear movement 73, which cross section is taken along a plane including the central axis of said actuator cylinder, which actuator cylinder is for the fail-safe type application. The air spring return direct acting rotary actuator cylinder 73 includes a third circular cylindrical cavity 74 disposed intermediate the first and second circular cylindrical cavities 75 and 76 wherein the first and second circular cylindrical cavities 75 and 76 include the elements constructed and arranged in the same way as those included in the actuator cylinder 49 of FIG. 2. The second partitioning wall 77 separating the second and third circular cylindrical cavities 76 and 74 from one another includes the seal ring 78 with the slit 79 into which seal ring the side opening 80 of the fluid passage 81 is directed, while the first partitioning wall 82 separating the first and third circular cylindrical cavities 75 and 74 from one another has a centrally disposed circular hole 84 with the sealing means 85 slidably receiving the hollow bar 84 coupling the second and fourth slidable partitioning bodies 87 and 86 to one another wherein the fourth slidable partitioning body 86 slidably engages the third circular cylindrical cavity 74 in an air-tight manner as facilitated by the sealing means 91, while the combination of the hollow bar 83 and the fourth slidable partitioning body 86 receives the rod 88 in a coaxial air-tight sliding relationship as facilitated by the sealing means 89. The compartment 90 intermediate the first partitioning wall 82 and the fourth slidable partitioning body 86 is vented by means of the vent opning 96. The compartment 92 intermediate the fourth slidable partitioning body 86 and the second partitioning wall 77 includes the port opening 93. The compartment 94 intermediate the first slidable partitioning body 95 and the second slidable partitioning body 87 is under constant pressurization by the compressed air that enters to said compartment through the port opening 97 with the check valve 98 and remain trapped in said compartment, which compressed air is supplied from the compressed air line upstream to the three way directional control valve installed to pressurize or vent the compartments 99, 100 and 92. The air spring return direct acting rotary actuator cylinder with the initial linear movement 73 operates in much the same principle as the actuator cylinder 49 of FIG. 2. When the compartments 99, 100 and 92 are pressurized, which action also pressurizes the compartment intermediate the second partitioning wall 77 and the third slidable partitioning body slidably disposed in the second circular cylindrical cavity 76, said actuator shifts to said the other extreme linear and angular position. When the three way directional control valve controlling the compressed air flow to the comparments 99, 100 and 92 is rotated to the "vent" position or the source of the compressed air supply system fails, the actuator cylinder is automatically shifted to said one extreme linear and angular position providing the fail-safe shut-off or the fail-safe opening of the valves.

Figure 4:
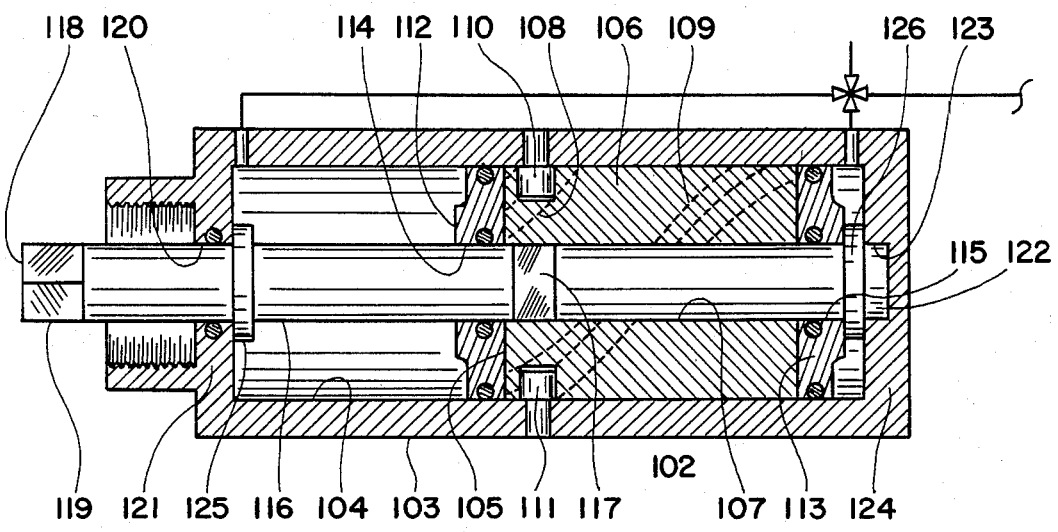
FIG. 4 illustrates a direct acting rotary actuator cylinder without the initial linear movement.

In FIG. 4 there is illustrated a cross section of a direct acting rotary actuator cylinder without the initial linear movement, which cross section is taken along a plane including the central axis of said actuator cylinder. The direct acting rotary actuator cylinder without the initial linear movement 102 comprises a cylinder 103 including a circular cylindrical cavity 104 slidably engaged by a slidable partitioning body 105 comprising the first cylindrical member 106 with a noncircular hole 107 and one or more grooves of the common pitch angle 108, 109, etc. disposed parallel to each other on the outer cylindrical surface of said first cylindrical member, which grooves are engaged by the cam rollers 110,111, etc. rigidly affixed to the cylindrical wall of said circular cylindrical cavity 104. The second cylindrical member of the slidable partitioning body 105 includes one or more circular cylindrical discs 112 and 113 with the circular holes 113 and 114 slidably engaged by the rod 116 in an air-tight manner, which circular cylindrical discs engage the circular cylindrical cavity 104 in an air-tight sliding relationship. The rod 116 has a circular cross section over most of the length and the midsection 117 with a noncircular cross section, which noncircular midsection slidably and nonrotatably engages the noncircular hole 107 disposed in the first cylindrical member 106 of the slidable partitioning body 105, while the circular portion of the rod 116 slidably and rotatably engages the circular holes 114 and 115 included in the second cylindrical member of the slidable partitioning body 105 in an air-tight manner. Of course, the circular portion of the rod 116 slides through the noncircular hole 107 included in the first cylindrical member 106. One extremity 118 with a coupling means 119 of the rod 116 rotatably engages and extends through the circular hole 120 centrally disposed in one end wall 121 in an air tight manner, while the other extremity 122 is rotatably supported by the circular hole 123 centrally disposed in the other end wall 124 in a leak-proof manner. The shoulders 125 and 126 on the rod 116 are employed to retain the rod 116 in the position against the axial thrust force. It is readily recognized that the actuator cylinder 102 has essentially the same construction as the actuator cylinder 1 of FIG. 1 less those elements required for creating the initial linear movement. The operating principle of the actuator cylinder 102 is simple: The pressurization of the one compartment and the venting of the other compartment rotates the rod 116 to one extreme angular position. The pressurization of said the other compartment and the venting of said one compartment rotates the rod 116 to the other extreme angular position.

Figure 5:
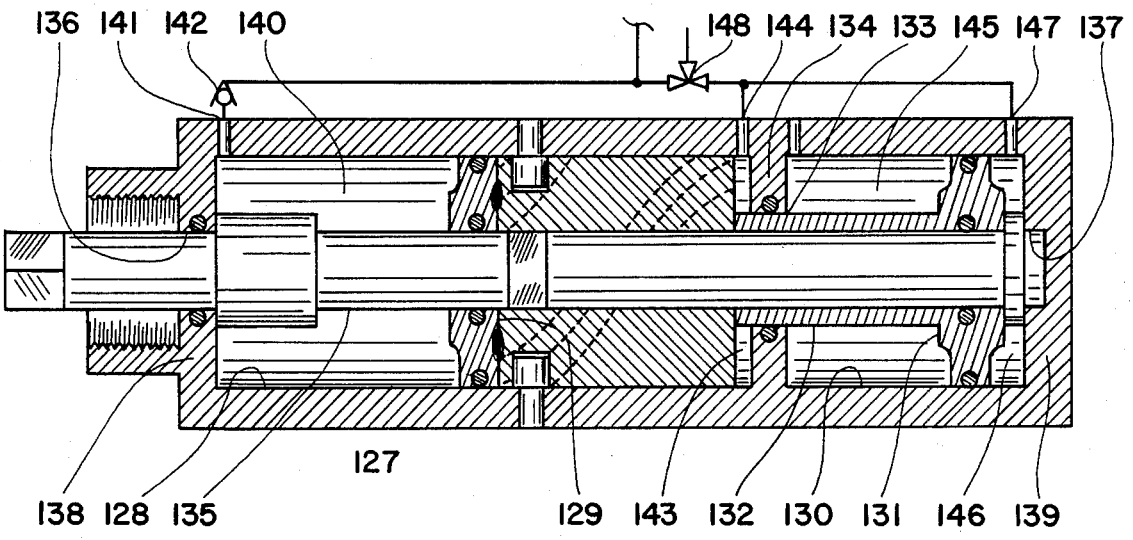
FIG. 5 illustrates another direct rotary actuator cylinder without the initial linear movement that returns automatically to the initial angular position whenever the supply of the pressurized fluid to said actuator cylinder is halted or fails.

In FIG. 5 there is shown a cross section of an air spring return direct acting rotary actuator cylinder without the initial linear movement 127, which includes the first circular cylindrical cavity 128 including the first slidable partitioning body 129 constructed and arranged in the same way as the corresponding elements included in the circular cylindrical cavity of the actuator cylinder 102 of FIG. 4 and, in addition, the second circular cylindrical cavity 130 slidably engaged by the second slidable partitioning body 131 in an air-tight manner, which second slidable partitioning body 131 is connected to the first slidable partitioning body 129 by a hollow circular cylinder 132 slidably receiving the rod 135 in an air tight manner and slidably and rotatably engaging and extending through the circular hole 133 centrally disposed in the partitioning wall 134 separating the first and second circular cylindrical cavities 128 and 130 from one another in an air-tight sliding relationship. The rod 135 is disposed along the central axis of the circular cylindrical cavities 128 and 130 wherein one extremity with a coupling means rotatably engages and extends through a first circular hole 136 centrally disposed in one end wall 138 in an air-tight manner, while the other extremity is rotatably supported by the second circular hole 137 disposed in the other end wall 139 in a leak-proof manner. The compartment 140 intermediate the first end wall 138 and the first slidable partitioning body 129 is provided with an extra large volume and the port opening 141 equiped with the check valve 142; whereby, the compressed air entering said compartment becomes trapped in said compartment and provides the air spring force acting on the face of the first slidable partitioning body 129 adjacent to said compartment 140. The compartment 143 intermediate the first slidable partitioning body 129 and the partitioning wall 134 is provided with the port opening 144, while the compartment 145 intermediate the partitioning wall 134 and the second slidable partitioning body 131 is vented. The port opening 147 is included in the compartment 146 intermediate the second slidable partitioning body 131 and the other end wall 139. The port openings 144 and 147 are connected to the common line downstream of the three way directional control valve 148 supplying the compressed air while the port opening 141 with the check valve 142 is connected to the compressed air line upstream to the control valve 148. The actuator cylinder 127 operates in the following principles: When the compartments 143 and 146 are pressurized, the rod 135 rotates to one extreme angular position. When the control valve 148 is rotated to the venting position intentionally or the supply of the compressed air fails accidentally, the rod 135 is automatically rotated back to the other extreme angular position. It is readily recognized that any one of the four compartments included in the actuator cylinder 127 can be used as an air spring chamber provided a sufficient volume and the check valve are included, wherein two of the remaining three compartments counteracting the air spring force from the air spring compartment when said two compartments are pressurized are connected to the compressed air line via the three way control valve while the remaining one compartment is vented to the ambient atmosphere.

While the principles of the present invention have now been made clear by the illustrative embodiment, there will be immediately obvious to the skilled in the art many modifications of the structure, arrangements, proportion, elements and material which are particularly adapted to the specific working environment and the operating condition without departing from those principles.

We claim:

1. A direct acting rotary actuator cylinder with an initial linear movement comprising in combination:

(a) a cylinder including a first circular cylindrical cavity with a first end wall having a centrally disposed circular hole and a second end wall with a centrally disposed circular hole;

(b) a rod with a circular cross section coaxially disposed in said first circular cylindrical cavity with one extremity rotatably and slidably engaging and extending through the circular hole centrally disposed through said first end wall in an air-tight manner and the other extremity engaging and extending through the circular hole centrally disposed through said second end wall, said rod having a noncircular cross section over a mid-portion of its length wherein the minimum diametrical dimension of said noncircular cross section is greater than the diameter of said circular cross section;

(c) a first slidable partitioning body slidably disposed adjacent to said first end wall in said first circular cylindrical cavity and dividing said first circular cylindrical cavity into a first compartment adjacent to said first end wall and a second compartment in an air-tight manner, said first slidable partitioning body pierced by and rigidly affixed to said rod in an air-tight manner;

(d) a second slidable partitioning body slidably disposed adjacent to said second end wall in said first circular cylindrical cavity and dividing said first circular cylindrical cavity into said second compartment intermediate said first and second slidable partitioning bodies, and a third compartment adjacent to said second end wall in an air-tight manner, said second slidable partitioning body including;

(1) a first cylindrical member having a centrally located noncircular hole slidably and nonrotatably engaged by the noncircular portion of said rod at least in part and having a plurality of helical grooves of common pitches disposed on the outer cylindrical surface of said first cylindrical member, said plurality of helical grooves slidably engaged by a plurality of guide means affixed to the cylindrical wall of said first circular cylindrical cavity;

(2) at least one second cylindrical member having a centrally located circular hole slidably and rotatably engaged by the circular portion of said rod in an air-tight manner, said at least one second cylindrical member slidably engaging said first circular cylindrical cavity in an air-tight manner wherein said at least one second cylindrical member is kinematically linked to said first cylindrical member;

(e) mechanical locking means affixed to said rod, said mechanical locking means locking onto said cylinder and thus preventing the rotating movement of said rod relative to said cylinder when said rod is moved to one extreme linear and one extreme angular position, said locking means unlocking from said cylinder when said rod is moved from said one extreme linear position toward to the other extreme linear position opposite to said one extreme linear position over a predetermined distance;

(f) a first port disposed adjacent to said first end wall and open to said first compartment;

(g) a second port adjacent to said first end wall and open to said second compartment; and (h) a third port adjacent to said second end wall and open to said third compartment;

whereby, the pressurization of said second compartment and the venting of said first and third compartments moves said rod first to one extreme angular position and then to said one extreme linear position wherein said locking means prevents the rotation of said rod relative to said cylinder, and the venting of said second compartment and the pressurization of said first and third compartments moves said rod first to said the other extreme linear position and then to the other extreme angular position opposite to said one extreme angular position.

2. The combination as set forth in claim 1 wherein said combination further including a check valve preventing the flow out of said first compartment included in said first port and a fluid passage disposed through said rod with one end open to said first compartment and the other end emerging through the cylindrical surface of said rod and into a seal ring affixed to said cylinder with a slit open to said third compartment wherein said other end of said fluid passage lines up with said slit included in said seal ring only when said rod is fully rotated to said one extreme angular position; whereby, the linear movement of said rod toward to said one extreme linear position takes place only after the rod is fully rotated to said one extreme angular position because of the delayed venting of said first compartment implemented by said check valve and said fluid passage.

3. The combination as set forth in claim 1 wherein said cylinder further including;

(a) a second circular cylindrical cavity with a third end wall having a centrally disposed circular hole rotatably and slidably engaged through by said other extremity of said rod in an air-tight manner, said second circular cylindrical cavity disposed coaxially to and separated from said first circular cylindrical cavity by said second end wall;

(b) a third slidable partitioning body pierced by and rigidly affixed to said rod and dividing said second circular cylindrical cavity into a fourth compartment adjacent to said second end wall and a fifth compartment adjacent to said third end wall in an air-tight manner;

(c) a fourth port disposed adjacent to said third end wall and open to said fifth compartment; and (d) a fluid passage disposed through said rod with one end open to said first compartment and the other end open to to said fourth compartment, said fluid passage including a branch opening emerging through the cylindrical surface of said rod and into a seal ring affixed to said cylinder with a slit open to said third compartment wherein said branch opening of said fluid passage lines up with said slit included in said seal ring only when said rod is fully rotated to said extreme angular position;

whereby, the pressurization of said second compartment and the venting of said first and third compartments first moves said rod to said one extreme angular position and then to said one extreme linear position, and the venting of said second compartment and the pressurization of said first and third compartment moves first said rod to said other extreme linear position and then to said other extreme angular position.

4. The combination as set forth in claim 3 wherein said first port includes a check valve allowing the flow into said first compartment and preventing the flow out of said first compartment.

5. A direct acting rotary actuator cylinder with an initial linear movement comprising in combination:

(a) a cylinder including a first circular cylindrical cavity with a first end wall having a centrally disposed circular hole and a second end wall with a centrally disposed circular hole;

(b) a rod with a circular cross section coaxially disposed in said first circular cylindrical cavity with one extremity rotatably and slidably engaging and extending through the circular hole centrally disposed through said first end wall in an air-tight manner and the other extremity engaging and extending through the circular hole centrally disposed through said second end wall, said rod having a noncircular cross section over a mid-portion of its length wherein the minimum diametrical dimension of said noncircular cross section is greater than the diameter of said circular cross section;

(c) a first slidable partitioning body slidably disposed adjacent to said first end wall in said first circular cylindrical cavity and dividing said first circular cylindrical cavity into a first compartment adjacent to said first end wall and a second compartment in an air-tight manner, said first slidable partitioning body pierced by and rigidly affixed to said rod in an air-tight manner;

(d) a second slidable partitioning body slidably disposed adjacent to said second end wall in said first circular cylindrical cavity and dividing said first circular cylindrical cavity into said second compartment intermediate said first and second slidable partitioning bodies, and a third compartment adjacent to said second end wall in an air-tight manner, said second slidable partitioning body including;

(1) a first cylindrical member having a centrally located noncircular hole slidably and nonrotatably engaged by the noncircular portion of said rod at least in part and having a plurality of helical grooves of common pitches disposed on the outer cylindrical surface of said first cylindrical member, said plurality of helical grooves slidably engaged by a plurality of guide means affixed to the cylindrical wall of said first circular cylindrical cavity;

(2) at least one second cylindrical member having a centrally located circular hole slidably and rotatably engaged by the circular portion of said rod in an air-tight manner, said at least one second cylindrical member slidably engaging said first circular cylindrical cavity in an air-tight manner wherein said at least one second cylindrical member is kinematically linked to said first cylindrical member;

(e) a fluid passage disposed through said rod with one end open to said first compartment and the other end emerging through the cylindrical surface of said rod and into a seal ring affixed to said cylinder with a slit open to said third compartment wherein said other end of said fluid passage lines up with said slit included in said seal ring only when sad rod is fully rotated to one extreme angular position;

(f) a first port with a check valve disposed adjacent to said first end wall and open to said first compartment, said check valve allowing the flow into said first compartment and preventing the flow out of said first compartment;

(g) a second port disposed adjacent to said first end wall and open to said second compartment;

(h) a third port disposed adjacent to said second end wall and open to said third compartment;

whereby, the pressurization of said second compartment and the venting of said third compartment moves said rod first to said one extreme angular position and then to one extreme linear position, and the venting of said second compartment and the pressurization of said first and third compartments moves said rod to the other extreme linear position opposite to said one extreme linear position and to the other extreme angular position opposite to said one extreme angular position.

6. The combination as set forth in claim 5 wherein said cylinder further including;

(a) a second circular cylindrical cavity with a third end wall having a centrally disposed circular hole rotatably and slidably engaged through by said other extremity of said rod in an air-tight manner, said second circular cylindrical cavity disposed coaxially to and separated from said first circular cylindrical cavity by said second end wall;

(b) a third slidable partitioning body pierced by and affixed to said rod in air-tight manner and dividing said second circular cylindrical cavity into a fourth compartment adjacent to said second end wall and a fifth compartment adjacent to said third end wall in an air-tight manner;

(c) a fourth port disposed adjacent to said third end wall and open to said fifth compartment; and (d) an additional fluid passage disposed through said rod with one end open to said fluid passage and the other end open to said fourth compartment.

7. An air-spring return direct acting rotary actuator cylinder with an initial linear movement comprising in combination;

(a) a cylinder including;

(1) a first circular cylindrical cavity with a first end wall having a centrally disposed circular hole and a second end wall having a centrally disposed circular hole;

(2) a second circular cylindrical cavity with a third end wall having a centrally disposed circular hole, said second circular cylindrical cavity disposed coaxially to and separated from said first circular cylindrical cavity by said second end wall;

(3) a third circular cylindrical cavity with a fourth end wall having a centrally disposed circular hole, said third circular cylindrical cavity disposed coaxially to and separated from said second circular cylindrical cavity by said third end wall;

(b) a rod with a circular cross section coaxially disposed through said first, second and third circular cylindrical cavities and rotatably and slidably engaging and extending through the circular holes centrally disposed through said first, third and fourth end walls in an air-tight manner and through the circular hole centrally disposed through said second end wall with a substantial clearance, said rod having a noncircular cross section over a midportion of its length disposed within sid first circular cylindrical cavity wherein the minimum diametrical dimension of said noncircular cross section is greater than the diameter of said circular cross section;

(c) a first slidable partitioning body slidably disposed adjacent to said first end wall in said first circular cylindrical cavity and dividing said first cylindrical cavity into a first compartment adjacent to said first end wall and a second compartment in an air-tight manner, said first slidable partitioning body piereced by and rigidly affixed to said rod in an air-tight manner;

(d) a second slidable partitioning body slidably disposed in said first circular cylindrical cavity and dividing said first circular cylindrical cavity into said second compartment intermedate said first and second slidable partitioning bodies and a third compartment adjacent to said second end wall in air-tight manner, said second slidable partitioning body including;

(1) a first cylindrical member having a centrally located noncircular hole slidable and nonrotatably engaged by the noncircular portion of said rod at least in part and having a plurality of helical grooves of common pitches disposed on the outer cylindrical surface of said first cylindrical member, said plurality of helical grooves slidably engaged by a plurality of guide means affixed to the cylindrical wall of said first circular cylindrical cavity;

(2) at least one second cylindrical member having a centrally located circular hole slidably and rotatably engaged by the circular portion of said rod in an air-tight manner, said second cylindrical member slidably engaging said first circular cylindrical cavity in an air-tight manner wherein said at least one second cylindrical member is kinematically linked to said first cylindrical member;

(e) a third slidable partitioning body slidably disposed in said second circular cylindrical cavity and dividing said second circular cylindrical cavity into a fourth compartment adjacent to said second end wall and a fifth compartment adjacent to said third end wall in an air-tight manner, said third slidable partitioning body including a centrally located circular hole rotatably and slidably engaged by the circular portion of said rod in an air-tight manner wherein said third slidable partitioning body is spaced away from said second slidable partitioning body by a hollow circular cylinder slidably engaged by the circular portion of said rod in an air-tight manner and slidably engaging and extending through the circular hole disposed through said second end wall in air-tight manner;

(f) a fourth slidable partitioning body pierced by and rigidly affixed to the circular portion of said rod in an air-tight manner and dividing said third circular cylindrical cavity into a sixth compartment adjacent to said third end wall and a seventh compartment adjacent to said fourth end wall;

(g) a first port disposed adjacent to said first end wall and open to said first compartment;

(h) a second port with a check valve disposed adjacent to said first end wall and open to said second compartment, said check valve allowing the flow into and preventing the flow out of said second compartment;

(i) a third port disposed adjacent to said second end wall and open to said third compartment;

(j) a fourth port disposed adjacent to said second end wall and open to said fourth compartment;

(k) a fifth port disposed adjacent to said third end wall and open to said fifth compartment;

(l) a sixth port disposed adjacent to said fourth end wall and open to said seventh compartment;

(m) a fluid passage disposed through said rod with one end open to said first compartment and the other end open to said sixth compartment, said fluid passage including a branch opening emerging through the cylindrical surface of said rod and into a seal ring affixed to said cylinder, said seal ring including a slit open to said fifth compartment wherein said branch opening of said fluid passage lines up with said slit including in said seal ring only when said rod is fully rotated to one extreme angular position;

whereby, the pressurization of said first, second, third and fifth compartments moves said rod to the other extreme linear position and to the other extreme angular position opposite to said one extreme angular position, and the venting of said first, third and fifth compartments automatically moves said rod first to said one extreme angular position and then to one extreme linear position opposite to said other extreme linear position.

8. The combination as set forth in claim 7 wherein another check valve allowing the flow into and preventing the flow out of said first compartment is included in said first port.

9. The combination as set forth in claim 7 wherein said rod includes a mechanical locking means affixed to said rod, said mechanical locking means locking onto said cylinder and thus preventing the rotating movement of said rod relative to said cylinder when said rod is moved to said one extreme linear and said one extreme angular position, said locking means unlocking from said cylinder when said rod is moved from said one extreme linear position toward to said other extreme linear position over a predetermined distance; whereby, said rod moves first to said other extreme linear position and then to said other extreme angular position when first, second, third and fifth compartments are pressurized.

10. The combination as set forth in claim 9 wherein another check valve allowing the flow into and preventing the flow out of said first compartment is included in said first port.

* * * * *